US005213278A

United States Patent [19]

Holbek et al.

[11] Patent Number: 5,213,278

[45] Date of Patent: May 25, 1993

[54] APPARATUS FOR APPLYING WEB SHAPED MATERIAL TO A SUBSTRATE

[75] Inventors: John V. Holbek, Lyngby; Bjarne K. Beck, Soborg, both of Denmark

[73] Assignee: A/S Jens Villadsens Fabriker, Herlev, Denmark

[21] Appl. No.: 863,511

[22] Filed: Mar. 31, 1992

Related U.S. Application Data

[63] Continuation of Ser. No. 613,915, Dec. 11, 1990, abandoned.

[30] Foreign Application Priority Data

Jun. 23, 1988 [DK] Denmark ..... 3460/88

[51] Int. Cl.[5] ..... B32B 35/00; B65H 16/00; B65H 23/00

[52] U.S. Cl. ..... 242/94; 242/86.4; 156/497; 156/499

[58] Field of Search ..... 242/94, 86.2, 86.3, 242/86.4, 86, 86.52; 156/497, 499

[56] References Cited

U.S. PATENT DOCUMENTS

| | | | |
|---|---|---|---|
| Re. 32,160 | 5/1986 | Kugler et al. | 156/497 |
| 2,123,415 | 7/1938 | Gorbatenko | 156/499 |
| 3,009,667 | 11/1961 | Browne | 242/94 |
| 3,350,256 | 10/1967 | Eckman et al. | 156/497 |
| 3,962,016 | 6/1976 | Alfter et al. | 156/497 |
| 4,243,468 | 1/1981 | Boyd | 242/86.52 |
| 4,725,328 | 2/1988 | Arnold | 156/497 |
| 4,746,078 | 5/1988 | Setzke | 242/94 |
| 4,761,201 | 8/1988 | Nichols, Jr. | 156/497 |
| 4,806,194 | 2/1989 | Wald | 156/497 |
| 4,913,772 | 4/1990 | Taylor et al. | 156/499 |

FOREIGN PATENT DOCUMENTS

| | | |
|---|---|---|
| 146859B | 1/1984 | Denmark . |
| 1198519 | 8/1965 | Fed. Rep. of Germany . |
| 2583449 | 12/1986 | France . |
| 2608191 | 6/1988 | France . |
| 8102144 | 5/1984 | Sweden . |
| 747965 | 7/1980 | U.S.S.R. . |
| 82/04278 | 12/1982 | World Int. Prop. O. . |

*Primary Examiner*—Daniel P. Stodola
*Assistant Examiner*—John Q. Nguyen
*Attorney, Agent, or Firm*—Watson, Cole, Grindle & Watson

[57] ABSTRACT

An apparatus serves for applying web shaped material to a substrate. The apparatus includes a frame structure having bearings for mounting a roll of the material. The frame structure supports guides for the web. A mount together with the guides are arranged in such a way that a part of the web being applied is accessible for heating by a burner arrangement. In order to obtain a secure controlling of the roll during application of the web shaped material, the guides for the web are arranged upon the frame structure in such a way that the web is moved from the roll in an upward direction, around the guides and downward around part of the outer circumference of the roll between the roll and the substrate.

11 Claims, 2 Drawing Sheets

Figure 1:
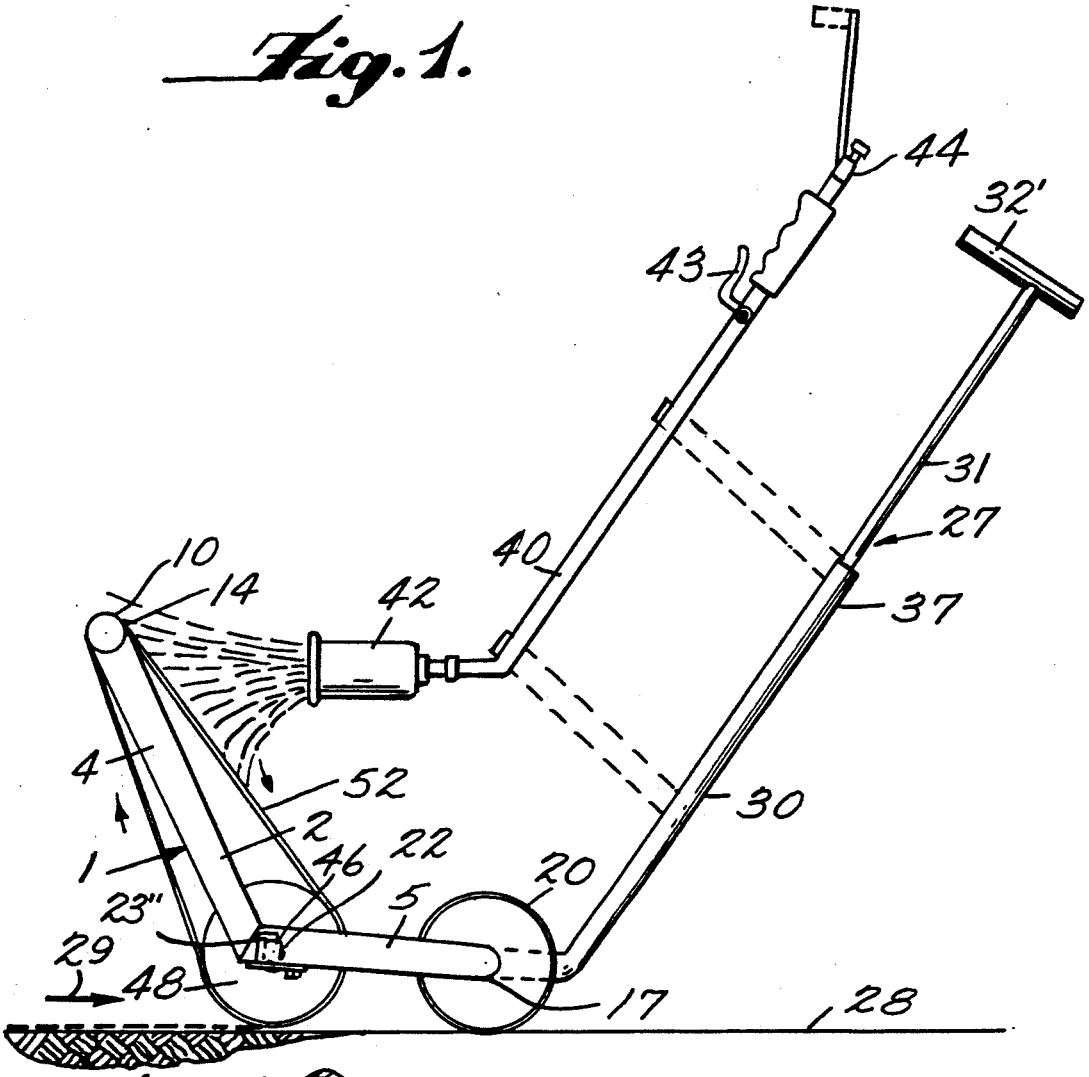

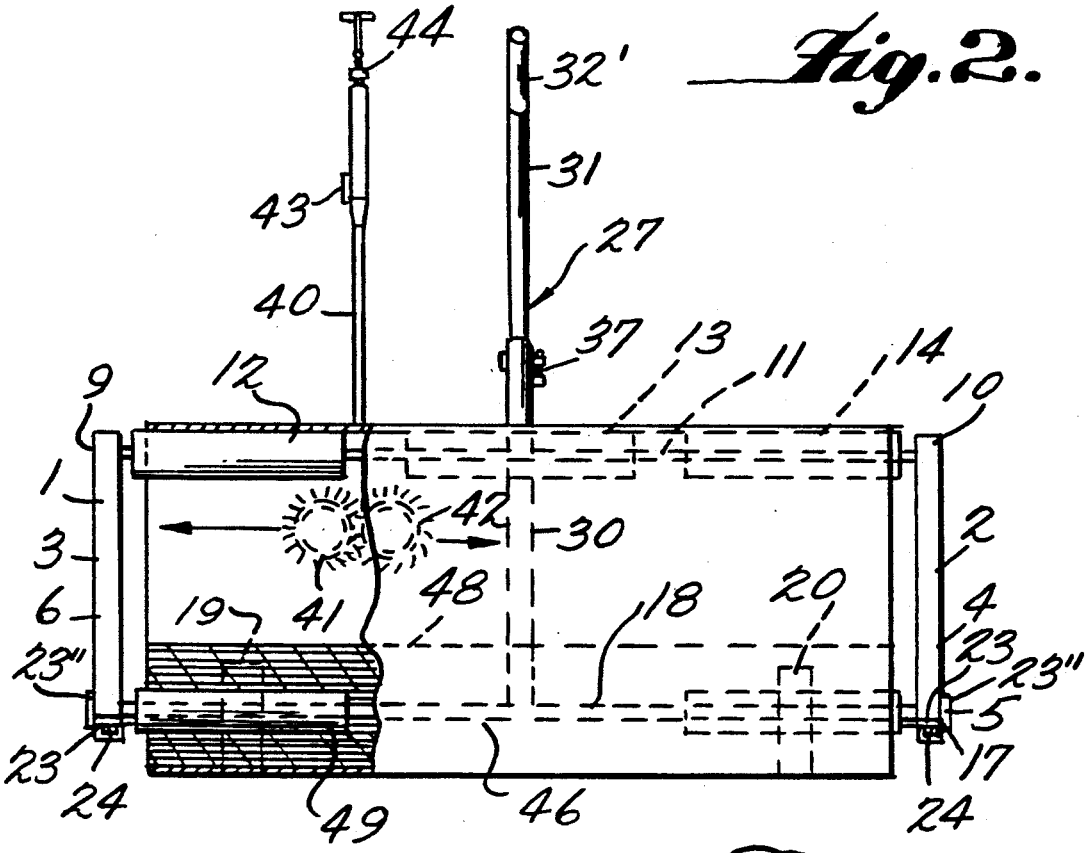
Fig. 2.
Fig. 3.
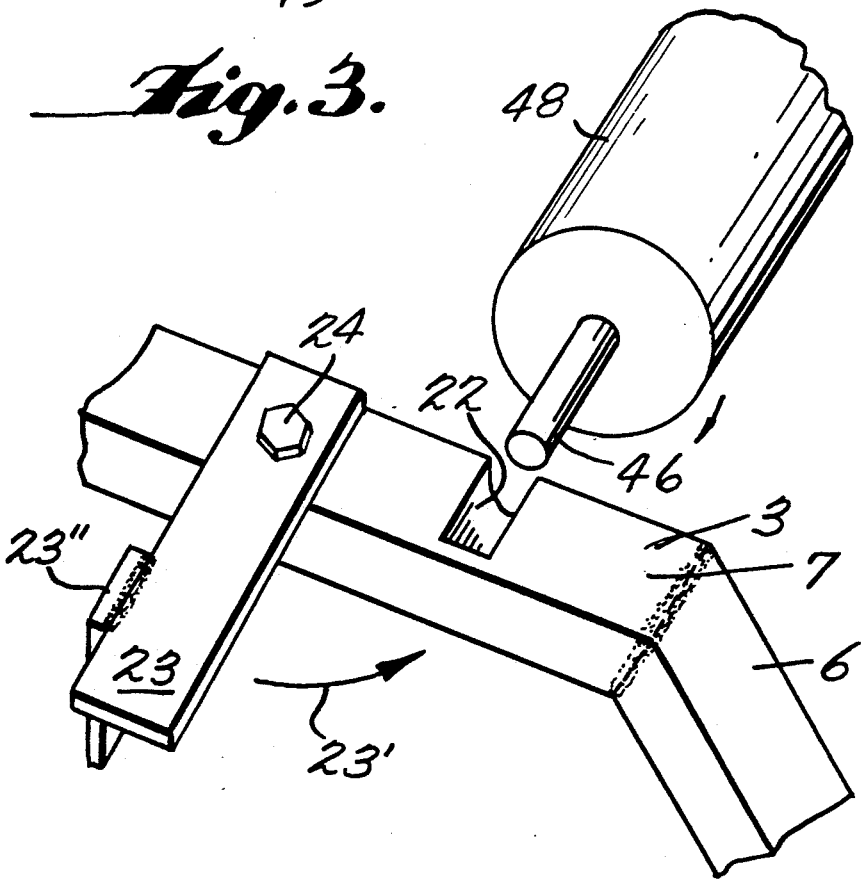

APPARATUS FOR APPLYING WEB SHAPED MATERIAL TO A SUBSTRATE

This is a continuation of application Ser. No. 613,915, filed Dec. 11, 1990, now abandoned.

The present invention relates to an apparatus for applying web shaped material upon a substrate and of the kind comprising a frame structure having moving means, means for rotatably mounting a roll of the material and guiding means for the web, the mounting means and the guiding means being so adapted that a part of the web unrolled from the roll of material is accessible for heating by means of a burner arrangement.

An apparatus of this kind is known from Derwent's Abstract No. C8008 D/13: SU-747-965. An apparatus of this kind is also known from FR-A-2 583 449. According to this prior art the mounting means for the web consist of two upward open bearing cavities arranged at the upper ends of two side rods of the frame structure. The guiding means for the web are constituted by a pressure roller rotatably supported in the frame structure below the roll. During application the web shaped material extends from the roll and inwardly below the pressure roller, viz. between the pressure roller and the substrate upon which the web shaped material is to be arranged. The burner arrangement of this known apparatus is arranged in such a way that the burner or burners are directed towards the gap between the pressure roller and, accordingly, towards the web shaped material guided around the pressure roller and towards the substrate. However, nothing prevents the burner according to FR-A 2 583 449 from being directed towards a part of the web to be unrolled from the roll of material at a distance from the substrate, while still being directed against the substrate, and also at a distance from the roll of material itself. When the apparatus in question is drawn with respect to the substrate by applying a pulling force to the moving means, the pressure roller presses the web firmly against the substrate after the web has been heated by means of the burner arrangement and the web is unrolled from the loosely mounted roll. If this known apparatus is moved at a high speed or is stopped abruptly, the roll will continue its movement of rotation due to its inertia and thereby a greater part of the roll will be unrolled than corresponding to the distance between the roll and the pressure roller. Therefore part of the web being heated may form buckles, and accordingly, may be slackened from the pressure roller and get too close to the burner arrangement.

According to the present invention the apparatus is characterized in that the mounting means for the web roll and the guiding means for the web are arranged on the frame structure in such a way that a web, when being unrolled, is moved in the upward direction from the roll around the guiding means and in the downward direction around the roll, between the roll and the substrate. By means of such construction, that the web being applied, due to the fact that it is wrapped around the roll being unrolled, will control the speed of rotation of the roll in such a way that uncontrolled rotation of the roll is avoided. This is because the roll will be rotated with generally the same peripheral speed as the speed with which the web is being rolled onto the substrate.

Figure 4:
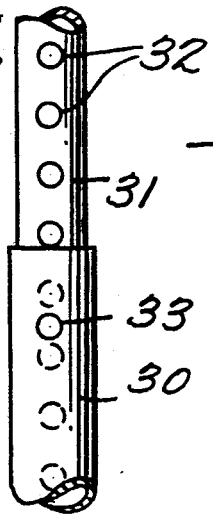
Figure 5:
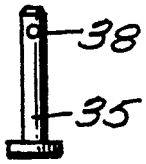
Figure 6:
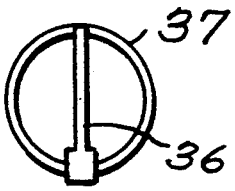

The invention will hereinafter be further explained with reference to the drawing on which FIG. 1 shows a side view of an embodiment of the apparatus according to the invention, FIG. 2 shows the same apparatus shown as seen from the left-hand side in FIG. 1, FIG. 3 shows a part of a side frame for the apparatus shown with the lower surface facing upward and a roll of web shaped material, FIG. 4 shows on an enlarged scale a section of moving means for the apparatus shown in FIG. 1, FIG. 5 shows a locking pin, and FIG. 6 shows a locking tongue.

Referring to the drawings, FIG. 1 is a frame structure for the apparatus shown. The frame structure consists of two side frames pieces 2,3, (FIG. 2), each of which has two parts 4,5 and 6,7 respectively. The two parts 4,5 and 6,7 respectively of each side frame form, as it appears from FIG. 1 wherein a side view of the apparatus is shown, an obtuse angle with each other. According to the embodiment shown the angle is approximately 120°. The ends 9,10 of the two side frames are mutually connected by means of a connecting rod 11 which supports web guiding means in the form of three idle rollers 12,13,14. The other ends 16,17 of the side frames 2 and 3, respectively, are mutually connected by means of an end frame 18 upon which two wheels 19,20 are rotatably supported as shown in FIG. 2.

Each of the two side frames 2 and 3 is provided with bearing means. The bearing means appear clearly in FIG. 3 which shows a part of the side frame 3 turned upside down. The bearing means comprise a bearing cavity 22 which in FIG. 3 faces upward but which in the position of use of the apparatus faces downward. A bearing cover 23 belongs to this bearing cavity and the cover 23 is, according to the embodiment shown, pivotally connected with the side frame piece 3 by means of a screw 24. The bearing cavity 22 is provided in the side part 7 and adjacent the apex of the angle which the two parts 6,7 of the side frame form with each other. A corresponding bearing means arrangement is provided in part 5 of side frame 2.

Moving means 27 are secured to the end frame 18 by means of which the frame structure 1 may be moved upon a substrate 28 in the direction of the arrow 29, FIG. 1. The moving means consist of a tubular part 30 secured to the end frame piece 18 and a rod 31 provided with a handle 32', and of which a part is accomodated in the tubular part 30. A row of holes 32 is provided in the rod 31 and a corresponding hole 33 extends through the upper end of the tubular part 30, see FIG. 4.

A pin 35, FIG. 5, belongs to the moving means and fits into the holes 32,33 in such a way that the rod 31 may be locked with respect to the tubular part 30 in different positions for adapting the total length of the moving means 27 consisting of the tubular part 30 and the rod 31. The pin 35 is locked in its inserted position by means of a locking tongue 36 which is pivotally connected with a securing ring 37 by means of which an easy withdrawal of the locking tongue 36 from the corresponding hole 38 in the locking pin 35 is achieved.

The apparatus also comprises a burner arrangement 40 shown in dotted lines in FIGS. 1 and 2, and which is provided with two burners 41,42. The burner arrangement is intended for connection with a source of gas, viz. by means of a stub 44 provided with a control valve 43 for controlling the flow of gas.

The burner arrangement may be supported by the frame structure 1 or the moving means 27 in a way known per se and, accordingly, not further illustrated.

However, in this respect reference is made to the international publication no. WO 82/04278 belonging to the same applicant.

As it appears from FIG. 1, the moving means 27 together with the frame parts 4,6 of the side frames 2 and 3 form an upward diverging angle i.e. an angle which diverges in direction away from the frame parts 5,7. The angle is approximately 60°. Such construction offers many possibilities for directing the burners 41,42 in such a way that only the web shaped material is heated whereas a heating of the substrate is avoided.

In order to control the roll 48 safely with respect to the shaft 46 reinforcing rollers 49 and 50 may be arranged on the shaft 46 as shown on FIG. 2.

The apparatus shown is used in the following way:

A shaft 46, cf. FIG. 3, is inserted through the opening of a roll of web material 48 to be applied to a substrate. The frame structure 1 is now arranged with the downward open bearing cavities 22 positioned over a corresponding one of the projecting ends of the shaft 46 with the bearing covers 23 pivoted to the position shown on FIG. 3. Now the bearing covers 23 are pivoted in the direction of the arrow 23' on FIG. 3 in such a way that the ends of the shaft are locked in the bearing cavities 22. The pivoting of each bearing cover 23 is limited by means of a stop lug 23" secured by welding. Now the free end of the web shaped material rolled into roll shape is withdrawn from the roll and moved upward around the guiding means 12,13 and 14 and again downward where the end of the web is wrapped around the roll 48. Thereby a part 52 unrolled from the roll of material is formed extending from the rollers 12,13,14 to the roll of material 48, which is accessible for heating. The apparatus is now prepared for applying the web in question, viz. by movement in a direction opposite the arrow 29, FIG. 1, by pulling the moving means 27. Before the applying is initiated, the web is heated by means of the burners 41,42. By tilting the moving means 27 more or less the frame of the frame structure may be tilted in such a way that the roll 48 is pressed more or less against the substrate 28. During the application itself, the speed with which the web material is rolled upon the substrate 28 will control the speed of rotation of the roll 48 about the shaft 46 because the peripheral speed of the roll will correspond to the onrolling speed of the web with respect to the substratum 28. This is due to the fact that the part of the web being applied is wrapped around the roll. The radius for that part of the web which passes the roll is a little longer, namely the thickness of the web longer, than the diameter of the outermost coil of the roll. This causes a tightening of the part of the web extending from the roll of material, up to the guiding means 12,13,14, around the latter and down to the roll of material. However, such tightening will only add to maintain the web part 52 in a tightened condition so that the web part 52 cannot flap or flutter and, accordingly, cannot be heated in a none-controllable way by means of the burners 41,42. Moreover, such tightening cannot superceed a definite value, namely the value at which a sliding between the part of the web being applied and the roll itself will occur.

According to the embodiment shown in the drawings the burner arrangement is intended to be carried and moved by the person who operates the apparatus simultaneously with the pulling of the apparatus but the apparatus may of course be provided with supporting means known per se in order to support and control the burner arrangement.

We claim:

1. An apparatus for applying web material upon a substrate, comprising:

a frame structure;

moving means in the form of interconnected rods with a handle at the upper end of the uppermost rod connected to said frame structure and the rods of the moving means forming an obtuse angle with the frame structure;

mounting means for rotatably mounting a roll of web material onto said frame structure;

guiding means mounted on said frame structure for rotation about an axis parallel to an axis of rotation of said roll on said mounting means, said guiding means mounted above said mounting means on said frame structure; and heating means for applying a burner flame to a portion of said web material to heat said portion during operation of the apparatus, said mounting means and said guiding means being mounted on said frame structure such that during operation said web of said roll mounted on said mounting means can be partially unrolled, moved in an upward direction from the roll, around the guiding means and in a downward direction around and in contact with the roll as the web material is applied to the substrate, wherein the web material passes between the roll and the substrate, the roll of the web material being thus both a magazine for the web material and a pressure roll for applying pressure to the web material at the point where the web material initially contacts the substrate, and wherein the heating means is mounted in such a way that it heats the web on a surface which is to come in contact with the substrate during the downward movement of the web from the guiding means toward the roll and substrate.

2. An apparatus as defined in claim 1, the frame structure of which comprises two side frames, each side frame comprising a substantially horizontal member and an upwardly directed member connected to an end of said substantially horizontal member such that the two members form an obtuse angle with respect to each other, wherein said side frames are mutually connected at upper portions of said upwardly directed members by a connecting rod which rotatably supports said guiding means, said guiding means being rollers, said side frames having their substantially horizontal members mutually connected at end portions opposite the ends connected to said upwardly directed members by an end frame, said end frame rotatably supporting support wheels, wherein said mounting means mutually connect said side frames at the end of said horizontal members adjacent the connection to said upwardly directed members, and wherein the radius for the part of the web which from the guiding means passes around the roll of the web material is greater than the diameter of the outermost coil of the roll thus causing a tightening of the web extending from the roll to the guiding means.

3. An apparatus as defined in claim 2, wherein a bearing cavity is provided in each substantially horizontal member in a side of each member facing said substrate, said cavities accommodating said mounting means for rotation in said cavities, and wherein each substantially horizontal member has a pivotable or removable bearing cover for preventing said mounting means rotatably disposed within said bearing cavity from being released from the bearing cavity.

4. An apparatus as in claim 2, wherein said rods of said moving means and said upwardly directed members form an upwardly diverging angle which diverges away from said substantially horizontal members.

5. An apparatus as in claim 4, wherein said angle is approximately 60°.

6. An apparatus for applying web material upon a substrate, comprising:

a frame structure;

moving means connected to said frame structure and forming an obtuse angle with the frame structure;

mounting means for rotatably mounting a roll of web material onto said frame structure;

guiding means mounted on said frame structure for rotation about an axis parallel to an axis of rotation of said roll on said mounting means, said guiding means mounted above said mounting means on said frame structure; and heating means for applying a burner flame to a portion of said web material to heat said portion during operation of the apparatus, said mounting means and said guiding means being mounted on said frame structure such that during operation said web of said roll mounted on said mounting means can be partially unrolled, moved in an upward direction from the roll, around the guiding means and in a downward direction around and in contact with the roll as the web material is applied to the substrate, the web material passes between the roll and the substrate, and wherein the heating means is mounted in such a way that it heats the web on a surface which is to come in contact with the substrate during the downward movement of the web from the guiding means toward the roll and substrate, said flame being expelled from said heating means in a direction which is substantially away from the substrate surface.

7. An apparatus as defined in claim 6, the frame structure of which comprises two side frames, each side frame comprising a substantially horizontal member and an upwardly directed member connected to an end of said substantially horizontal member such that the two members form an obtuse angle with respect to each other, wherein said side frames are mutually connected at upper portions of said upwardly directed members by a connecting rod which rotatably supports said guiding means, said guiding means being rollers, said side frames having their substantially horizontal members mutually connected at end portions opposite the ends connected to said upwardly directed members by an end frame, said end frame rotatably supporting support wheels, wherein said mounting means mutually connect said side frames at the end of said horizontal members adjacent the connection to said upwardly directed members.

8. An apparatus as defined in claim 7, wherein a bearing cavity is provided in each substantially horizontal member in a side of each member facing said substrate, said cavities accommodating said mounting means for rotation in said cavities, and wherein each substantially horizontal member has a pivotable or removable bearing cover for preventing said mounting means rotatably disposed within said bearing cavity from being released from the bearing cavity.

9. An apparatus for applying web material upon a substrate, comprising:

a frame structure;

moving means connected to said frame structure and forming an obtuse angle with the frame structure;

mounting means for rotatably mounting a roll of web material onto said frame structure;

web material in the form of a roll, said roll of web material functioning as both a magazine for the web material and as a pressure roll for applying pressure to the web material as it is applied to a substrate;

guiding means mounted on said frame structure for rotation about an axis parallel to an axis of rotation of said mounting means, said guiding means mounted above said mounting means on said frame structure; and heating means for applying a burner flame to a portion of said web material to heat said portion during operation of the apparatus, said mounting means and said guiding means being mounted on said frame structure such that during operation said web mounted on said mounting means is partially unrolled, moved in an upward direction from the roll, around the guiding means and in a downward direction around the roll so that as the web material is applied to the substrate, the web material passes between the roll and the substrate, and wherein the heating means is mounted in such a way that it heats the web on a surface which is to come in contact with the substrate during the downward movement of the web from the guiding means toward the roll and substrate.

10. An apparatus as defined in claim 9, the frame structure of which comprises two side frames, each side frame comprising a substantially horizontal member and an upwardly directed member connected to an end of said substantially horizontal member such that the two members form an obtuse angle with respect to each other, wherein said side frames are mutually connected at upper portions of said upwardly directed members by a connecting rod which rotatably supports said guiding means, said guiding means being rollers, said side frames having their substantially horizontal members mutually connected at end portions opposite the ends connected to said upwardly directed members by an end frame, said end frame rotatably supporting support wheels, wherein said mounting means mutually connect said side frames at the end of said horizontal members adjacent the connection to said upwardly directed members.

11. An apparatus as defined in claim 10, wherein a bearing cavity is provided in each substantially horizontal member in a side of each member facing said substrate, said cavities accommodating said mounting means for rotation in said cavities, and wherein each substantially horizontal member has a pivotable or removable bearing cover for preventing said mounting means rotatably disposed within said bearing cavity from being released from the bearing cavity.

* * * * *